United States Patent [19]

Ito et al.

[11] Patent Number: 4,539,958

[45] Date of Patent: Sep. 10, 1985

[54] METHOD OF LEARN-CONTROLLING AIR-FUEL RATIO FOR INTERNAL COMBUSTION ENGINE

[75] Inventors: Toshimitsu Ito; Nobuyuki Kobayashi, both of Toyota, Japan

[73] Assignee: Toyota Jidosha Kabushiki Kaisha, Toyota, Japan

[21] Appl. No.: 606,685

[22] Filed: May 3, 1984

[30] Foreign Application Priority Data

May 9, 1983 [JP] Japan ..... 58-80628

[51] Int. Cl.[3] ..... F02B 3/00

[52] U.S. Cl. ..... 123/440; 123/486; 123/488

[58] Field of Search ..... 123/480, 486, 440, 489, 123/488

[56] References Cited

U.S. PATENT DOCUMENTS 4,122,811 10/1978 Bowler ..... 123/440
4,130,095 12/1978 Bowler ..... 123/489
4,200,064 4/1980 Engele ..... 123/440
4,224,910 9/1980 O'Brien ..... 123/440
4,235,204 11/1980 Rice ..... 123/440
4,306,529 12/1981 Chiesa ..... 123/486
4,348,728 9/1982 Sagisaka ..... 123/480
4,365,299 12/1982 Konoo ..... 123/440

*Primary Examiner*—Ronald B. Cox
*Attorney, Agent, or Firm*—Cushman, Darby & Cushman

[57] ABSTRACT

In a method wherein a fuel injection time duration is allowed to perform a proportional-plus-integral action by the use of an air-fuel ratio feedback correction coefficient obtained from the output of an $O_2$ sensor thereby to control an air-fuel ratio to a target air-fuel ratio, a correction value for allowing a mean value of the air-fuel ratio feedback correction coefficient to approach a predetermined value is varied every time the air-fuel ratio feedback correction coefficient skips a plurality of times, thereby to learn-control the air-fuel ratio of an air-fuel mixture to be a stoichiometric one.

5 Claims, 7 Drawing Figures

METHOD OF LEARN-CONTROLLING AIR-FUEL RATIO FOR INTERNAL COMBUSTION ENGINE

BACKGROUND OF THE INVENTION

1. Field of the Invention

The present invention relates to a method of learn-controlling an air-fuel ratio for an internal combustion engine, particularly a spark-ignition engine, and more particularly, to a method of learn-controlling the air-fuel ratio by the use of a closed loop.

2. Description of the Prior Art

Hitherto, a three-way catalyst is employed for simultaneously purifying carbon monoxide, hydrocarbon and nitrogen oxide in an exhaust gas. In order to better the purifying efficiency of the three-way catalyst, such a closed loop control has been proposed and used that an air-fuel ratio is estimated by detecting the residual oxygen concentration in an exhaust gas by means of an $O_2$ sensor and is controlled so as to be in proximity of a stoichiometric air-fuel ratio. This closed loop control is effected in such a way that a fuel injection time duration TAU is obtained by multiplying a basic fuel injection time duration TP, which is determined by an engine load (an intake-pipe pressure PM or an intake-air quantity Q/Ne per revolution of the engine shaft) and an engine speed, by an air-fuel ratio feedback correction coefficient FAF, shown in FIG. 1, for allowing the fuel injection time duration to perform a proportional-plus-integral action in accordance with an air-fuel ratio signal which is delivered from the $O_2$ sensor and signal-shaped, and a fuel injection valve is opened for a period of time corresponding to the fuel injection in time duration TAU, thereby to control the air-fuel ratio so as to converge in proximity of the stoichiometric one. However, any change in environment or change with time may cause the variation of the valve timing due to the fluctuation in tappet clearance, as well as the change in characteristics of a pressure sensor, an air-flow meter and the fuel injection valve, so that it may become impossible to control the fuel injection quantity to a required fuel injection quantity of the engine, and the air-fuel ratio cannot be controlled so as to be in proximity of the stoichiometric one. For this reason, it is a conventional practice to correct the basic fuel injection time duration TP by employing correction values TAUG, KG which are corrected by learning under predetermined conditions as represented by the following equation:

$$TAU=(TP+TAUG)\cdot KG\cdot FAF\cdot(1+F)+\tau_v \quad (1)$$

where, TAUG represents a correction value which is corrected by learning during the period when a throttle valve is at fully closed position, KG a correction value which is corrected by learning during the period when the throttle valve is open, $\tau_v$ a non-effective injection time duration applied to voltage correction. And F a correction coefficient which is employed during a transient state, such as a quick acceleration of the engine. Further, the correction value KG is determined in accordance with the engine load: for example, correction values $KG_1$, $KG_2$, and $KG_3$ are employed when the intake-pipe pressure is 200 to 300 mmHg, 300 to 400 mmHg and 400 to 500 mmHg, respectively.

These correction values TAUG, KG are corrected by learning every time the correction coefficient FAF skips during the air-fuel ratio feedback control and when the engine cooling water temperature exceeds a predetermined value (70° C., for example) by the following method. First of all, every time the air-fuel ratio feedback correction coefficient FAF skips, an arithmetic means value FAFAV of peak values of the correction coefficient FAF is obtained as follows:

$$FAFAV=\frac{A+B}{2},\frac{B+C}{2},\frac{C+D}{2},\ldots \quad (2)$$

When FAFAV takes a value out of a predetermined range (±2%, for example), values shown the Table below are added to the pertinent correction values, respectively.

TABLE

| | TAUG | KG |
|---|---|---|
| 1.02 < FAFAV | +ΔA (μs) | +ΔK |
| 0.98 ≦ FAFAV ≦ 1.02 | 0 | 0 |
| FAFAV < 0.98 | −ΔA (μs) | −ΔK |

Then, the correction values TAUG, KG thus corrected by learning are applied to the above-mentioned equation (1) in accordance with the opening/closing state of the throttle valve and the magnitude of the intake-pipe pressure (or the intake-air quantity per revolution of the engine shaft), thereby to obtain the fuel injection time duration TAU. As a result, when the mean value FAFAV exceeds a predetermined value (1.02), the correction values are increased to control the air-fuel ratio to the richer side, and when the mean value FAFAV is less than a predetermined value (0.98), the correction values are decreased to control the air-fuel ratio to the leaner side, thereby to control the mean value FAFAV so as to converge in proximity of 1, that is, the stoichiometric air-fuel ratio.

In this conventional method, however, since the correction values are stored in a backup RAM or the like in the form of digital values, the number of bits with respect to the correction values cannot be increased on the grounds of the number of words in the backup RAM. Therefore, even when LSB (least significant bit) is corrected by learning, a correction value has a large change. In addition, since correction by learning is made every skip, a correction value may be corrected into an abnormal value in a short period of time. In consequence, the air-fuel ratio may be instable, disadvantageously. For example, if a correction value is stored in an eight-bit memory area in the backup RAM, 1 LSB, that is, resolution takes a considerably large value, i.e., 1/256 (0.4%). As a result, the air-fuel ratio is greatly varied by the value of 1 LSB, disadvantageously. To obviate this disadvantage, such a means may be employed that an offset is provided too allow the correction value 1.0 to be 512 and the range of change of the correction value to be +128. However, even in this case, 1 LSB is 1/512 (0.2%), so that the quantity of change of the air-fuel ratio becomes large similarly to the above, unfavorably.

For the above reason, correction by learning is made when the mean value FAFAV is beyond a predetermined range owing to an increase in fuel injection quantity for acceleration of the engine, for example, and when the engine operation is returned to the stationary state, the fuel injection time duration is determined by the value corrected by learning as above, so that it becomes impossible to control the air-fuel ratio so as to converge in proximity of a stoichiometric one.

SUMMARY OF THE INVENTION

The present invention has been accomplished to obviate the above-mentioned disadvantages of the prior art on the basis of such knowledge that the change in characteristics of various equipment requiring a learning control will not increase in a short period of time.

It is, accordingly, an object of the present invention to provide a method of learn-controlling the air-fuel ratio for an internal combustion engine which prevents any abnormal learning and makes it possible to control the air-fuel ratio to the optimum at all times.

To this end, according to the present invention, there is provided a method of learn-controlling the air-fuel ratio for an internal combustion engine, wherein a basic fuel injection time duration, which is determined by the engine load and the engine speed, is corrected by employing an air-fuel ratio feedback correction coefficient for allowing a fuel injection time duration to perform a proportional-plus-integral action in accordance with the output signal from an $O_2$ sensor for detecting the residual oxygen concentration in an exhaust gas, thereby to control the air-fuel ratio of an air-fuel mixture so as to be a target air-fuel ratio, as well as learn-control the air-fuel ratio feedback correction coefficient so as to approach a predetermined value every time the air-fuel ratio feedback correction coefficient skips a plurality of times.

As a result, correction by learning is made every plurality of skips, and the fuel injection time duration is corrected at a predetermined interval of time. In consequence, any unnecessary correction will never be made, and the air-fuel ratio is maintained optimum at all times to better the exhaust gas purifying efficiency as well as improve driveability, advantageously.

The above and other objects, features and advantages of the invention will become clear from the following description of the preferred embodiment taken in conjunction with the accompanying drawings.

DETAILED DESCRIPTION OF THE INVENTION

Figure 2:
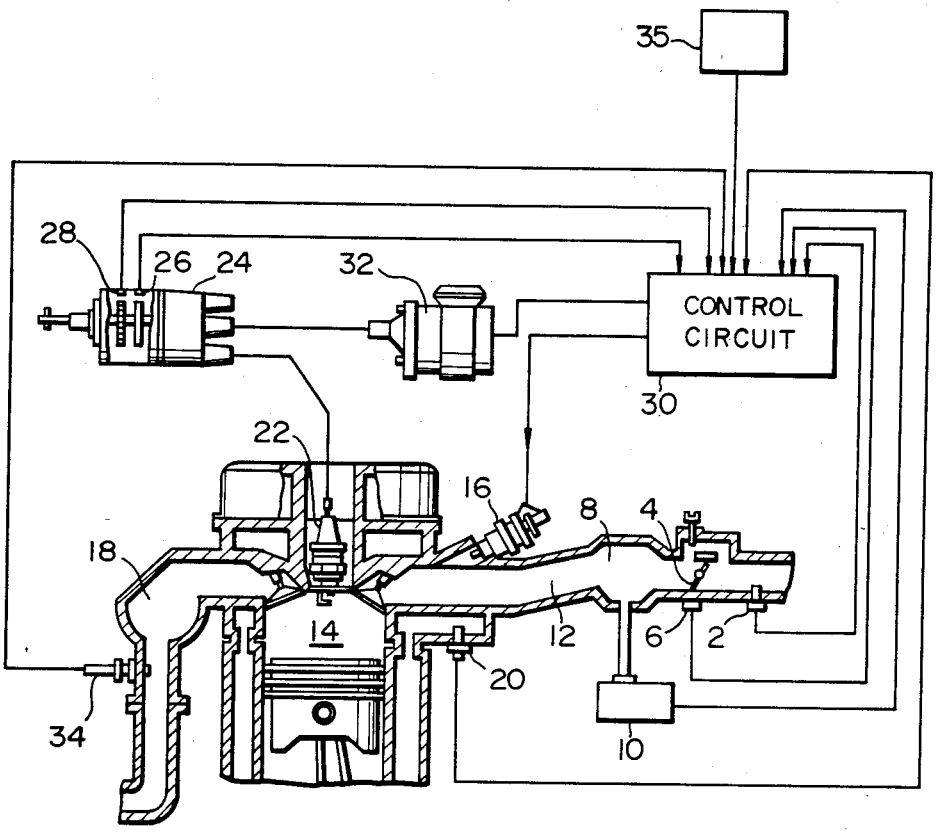
FIG. 2 is a schematic illustration of an example of an engine to which the present invention is applied.

An example of an internal combustion engine (referred to as simply "engine", hereinafter) to which the present invention is applied will be described hereinunder in detail with reference to FIG. 2. An intake-air temperature sensor 2, which detects the temperature of the intake air and delivers an intake-air temperature signal, is provided on the downstream side of an air cleaner (not shown). On the downstream side of the intake-air temperature sensor 2 is disposed a throttle valve 4, which is equipped with a throttle switch 6 which is interlocked with the throttle valve 4 and adapted to be made ON when the throttle valve 4 is at fully closed position and made OFF when the throttle valve 4 is opened. On the downstream side of the throttle valve 4 is provided a surge tank 8, which is equipped with a pressure sensor 10 which detects the intake-pipe pressure on the downstream side of the throttle valve 4 and delivers an intake-pipe pressure signal. The surge tank 8 is communicated with a combustion chamber 14 in the engine through an intake manifold 12. The intake manifold 12 has a fuel injection valve 16 provided for each of cylinders. The combustion chamber 14 in the engine is communicated with a catalytic converter (not shown) filled with a three-way catalyst through an exhaust manifold. Further, the engine block is equipped with a water temperature sensor 20 which detects the temperature of water for cooling the engine and delivers a water temperature signal. The end of a spark plug 22 is projected into the combustion chamber 14 in the engine, and a distributor 24 is connected to the spark plug 22. The distributor 24 is provided with a cylinder discriminating sensor 26 and an engine speed sensor 28 each constituted by a pickup secured to the distributor housing and a signal rotor secured to the distributor shaft. The cylinder discriminating sensor 26 delivers a cylinder discriminating signal every 720° CA, for example, to a control circuit 30 constituted by a microcomputer or the like, while the engine speed sensor 28 delivers a crank angle signal every 30° CA, for example, to the control circuit 30. In addition, the distributor 24 is connected to an ignitor 32. It is to be noted that a reference numeral 34 denotes an $O_2$ sensor which detects the residual oxygen concentration in an exhaust gas and delivers an air-fuel ratio signal, and a numeral 35 represents a vehicle speed sensor for detecting the vehicle speed.

Figure 3:
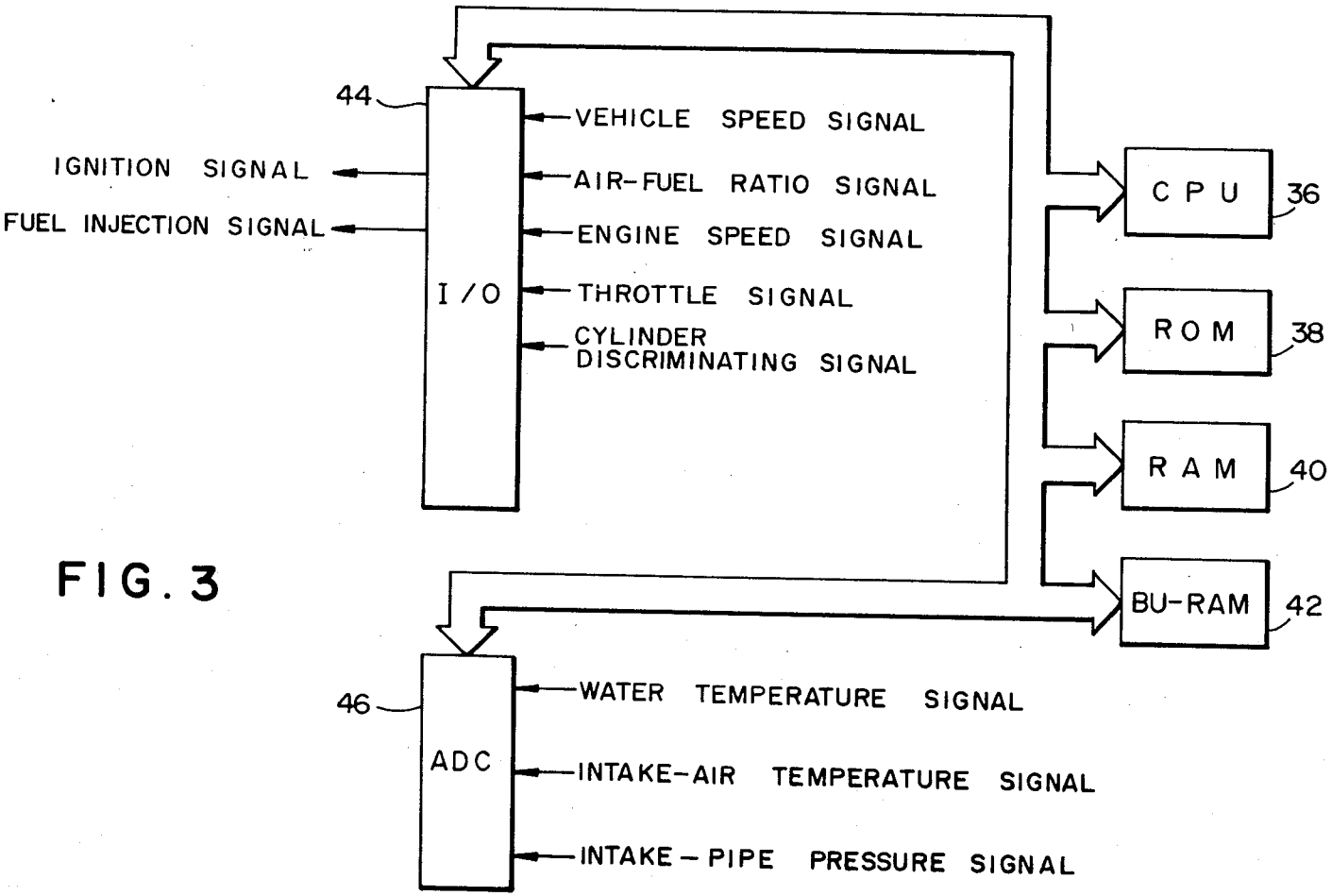
FIG. 3 is a block diagram showing a control circuit in FIG. 2.

The control circuit 30 includes, as shown in FIG. 3, a central processing unit (CPU) 36, a read-only memroy (ROM) 38, a random-access memory (RAM) 40, a backup RAM (BU-RAM) 42, an input/output port (I/O) 44, an analog-to-digital converter (ADC) 46 and buses, such as a data bus and a control bus for connecting these components to each other. Fed into the I/O 44 are the cylinder discriminating signal, the crank angle signal, the air-fuel ratio signal, the throttle signal delivered from the throttle switch 6, and the vehicle speed signal. Delivered from the I/O 44 are a fuel injection signal for controlling the opening/closing timings of the fuel injection valve 16 through a driving circuit and an ignition signal for controlling the ON/OFF timings of the ignitor 32. Further, the intake-pipe pressure signal, the intake-air temperature signal and the water temperature signal are fed into the ADC 46 and converted into digital signals, respectively.

The following is the description of an embodiment of the invention in which the above-described engine is employed. In this embodiment, the air-fuel ratio is controlled by means of a learning control, and the BU-RAM 42 has a memory area previously determined therein for storing the correction values TAUG, KG, ($KG_1$, $KG_2$, $KG_3$).

Figure 1:
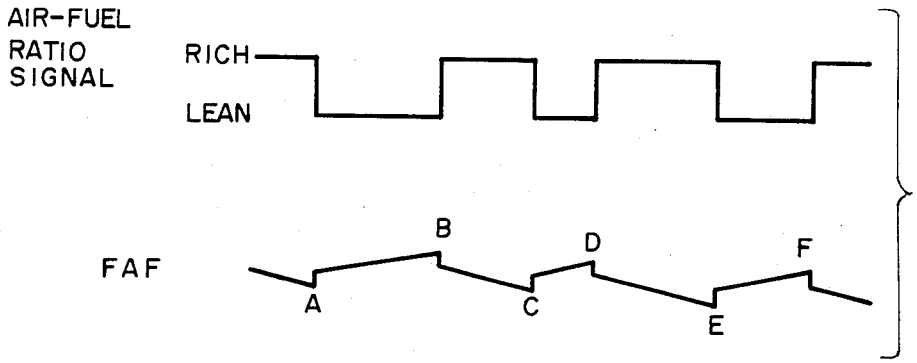
FIG. 1 PRIOR ART
FIG. 1 is a chart showing an air-fuel ratio signal and a correction coefficient FAF.
Figure 4:
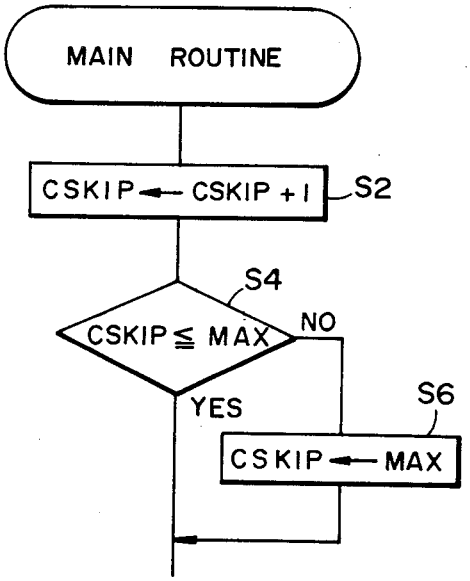
FIG. 4 is a flow chart showing a routine for incrementing a count.
Figure 5:
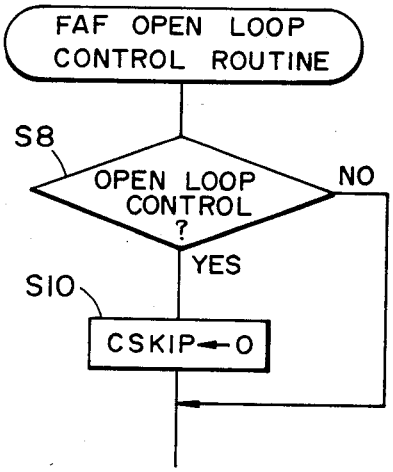
FIG. 5 is a flow chart showing a routine for clearing the count.

A processing routine in accordance with the embodiment will be explained hereinunder with reference to FIGS. 4 to 7. FIGS. 4 and 5 respectively show routines for calculating skips of the air-fuel ratio feedback correction coefficient FAF during the air-fuel ratio feedback control. FIG. 4 shows a main routine. In a step S2 in FIG. 4, the count CSKIP is incremented by one, and a judgement is made in a step S4 as to whether the count CSKIP exceeds a maximum value MAX or not. If the count CSKIP exceeds the maximum value MAX, the process proceeds to a step S6 in which the count CSKIP is set at the maximum value MAX in order to prevent any overflow. On the other hand, FIG. 5 shows a routine for an air-fuel ratio open loop control conducted, for example, when the power is increased. According to this routine, in a step S8, a judgement is made as to whether the air-fuel ratio open loop control is being effected or not. If the open loop control is being effected, the count CSKIP is closed in a step S10 to set the count CSKIP at zero.

As a result, the count CSKIP is made to count the number of skips of the air-fuel ratio feedback correction coefficient FAF on the basis of the point of time when the open loop control has shifted to the feedback loop control.

Figure 6:
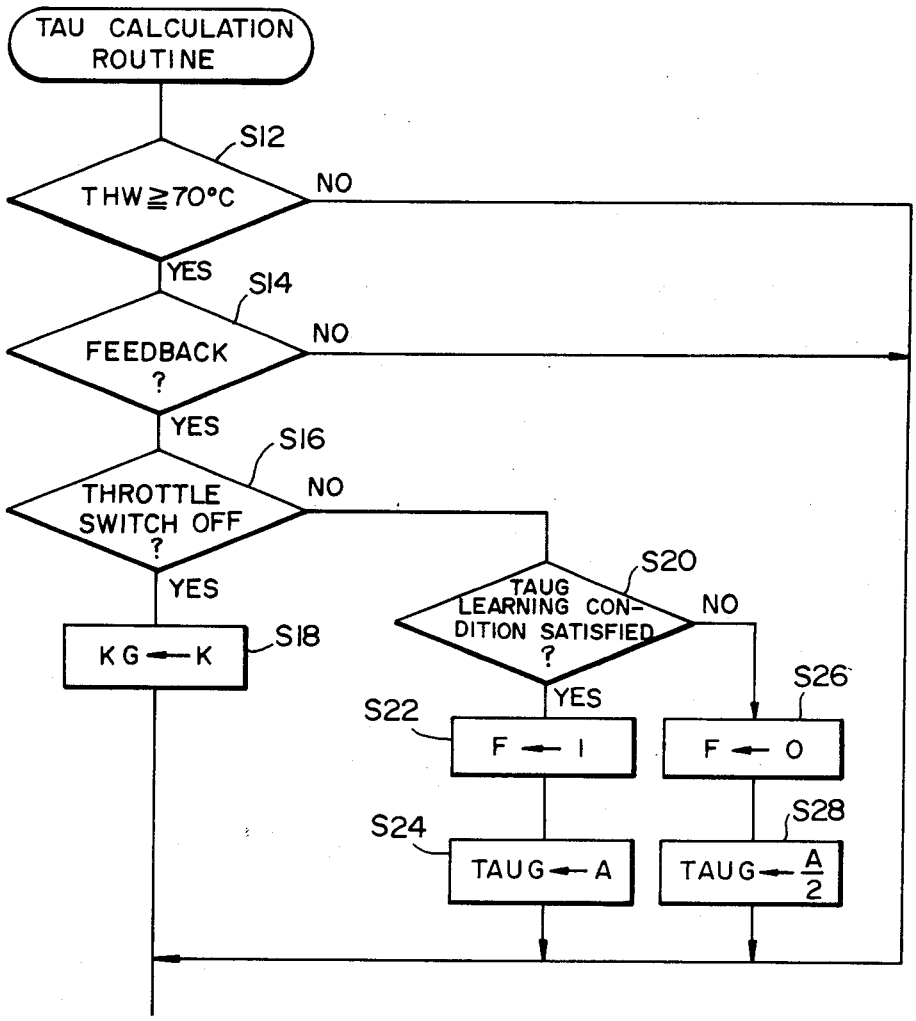
FIG. 6 is a flow chart showing a routine for calculating a fuel injection time duration.

Referring now to FIG. 6, which shows a routine for calculating the fuel injection time duration TAU, a judgement is made in a step S12 as to whether the engine cooling water temperature THW is not lower than a predetermined temperature (70° C., for example), and a judgement is made in a step S14 as to whether the air-fuel ratio feedback control is being effected or not, and moreover, a judgement is made in a step S16 as to whether the throttle switch is ON or OFF. When the cooling water temperature is at the predetermined temperature or higher and the air-fuel ratio feedback control is being effected and moreover the throttle switch is OFF, that is, when the learning conditions for the correction value KG are satisfied, in a step S18, a value K corrected by learning through a learning control routine shown in FIG. 7 and stored in the BU-RAM is employed as the correction value KG in the above-mentioned equation (1) in accordance with the intake-pipe pressure for calculation of the fuel injectin time duration TAU. When the cooling water temperature is at the predetermined temperature or higher and the air-fuel ratio feedback control is being effected and moreover the throttle switch is ON, a judgement is made in a step S20 as to whether the learing conditions for the correction value TAUG are satisifed or not. The learning conditions are, for example, as follows: the engine speed is not higher than a predetermined value (1,000 r.p.m., for example); the vehicle speed is zero; and the intake-pipe pressure is not lower than a predetermined value (180 mmHg, for example). When the learning conditions for the correction value TAUG are satisfied, a flag F is set in a step S22, and then, in a step S24, a value A corrected by learning through the learning control routine in FIG. 7 and stored in the BU-RAM is employed as the correction value TAUG in the equation (1) for calculation of the fuel injection time duration TAU. On the other hand, when the learning conditions for the correction value TAUG are not satisfied, the flag F is reset in a step S26, and then, in a step S28, ½ of the value A corrected by learning through the learning control routine in FIG. 7 and stored in the BU-RAM is employed as the correction value TAUG in the equation (1) for calculation of the fuel injection time duration TAU.

Figure 7:
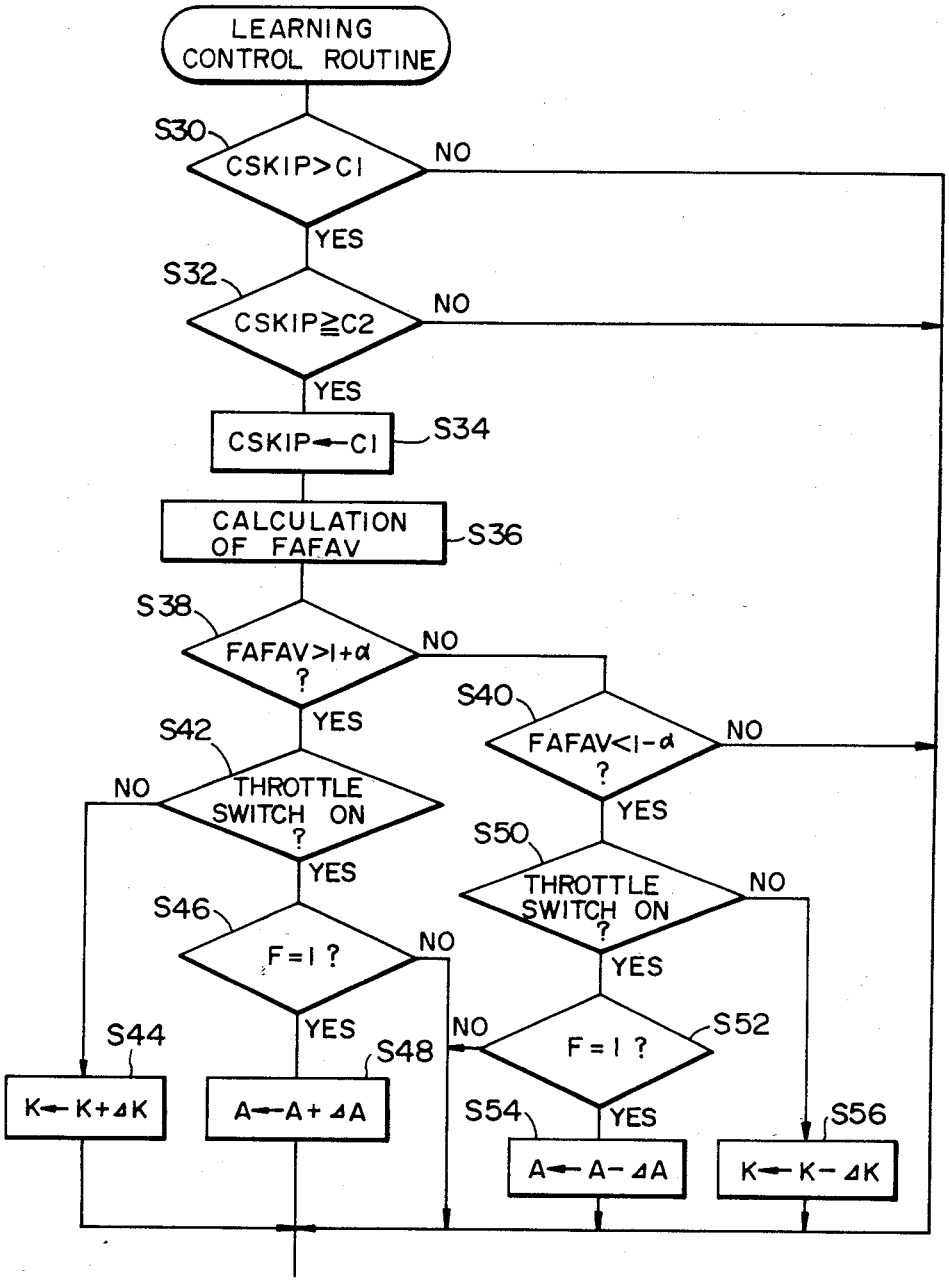
FIG. 7 is a flow chart showing a learning control routine.

Referring now to FIG. 7, which shows a learning control routine, a judgement is made in a step S30 as to whether the count CSKIP exceeds a predetermined value $C_1$ (three, for example) or not, and a judgement is made in a step S32 as to whether the count CSKIP exceeds a predetermined value $C_2$ ($C_2 > C_1$) or not. If the count CSKIP is not less than the predetermined value $C_2$, the count CSKIP is set at the predetermined value $C_1$ in a step S34, and then, in a step S36, the mean value FAFAV of the correction coefficient FAF is calculated through the above-mentioned equation (2).

In a subsequent step S38, a judgement is made as to whether the mean value FAFAV exceeds a predetermined value $1+\alpha$ (1.02, for example) or not, and a judgement is made in a step S40 as to whether the mean value FAFAV is less than a predetermined value $1<\alpha$ (0.98, for example) or not. If the mean value FAFAV exceeds the predetermined value $1+\alpha$, a judgement is made in a step S42 as to whether the throttle switch is ON or OFF. If the throttle switch is OFF, such correction by learning is made in a step S44 as adding a predetermined value $\Delta K$ (0.002, for example) to the value K as the correction value KG. If the throttle switch is ON, a judgement is made in a step S46 as to whether the flag F is set, that is, whether the learning conditions for the correction value TAUG are satisfied or not. Only when the flag F is set, such correction by learning is made in a step S48 as adding a predetermined value A (8 μsec, for example) to the value A as the correction value TAUG. On the other hand, if the mean value FAFAV is less than a predetermined value $1-\alpha$, a judgement is made in a step S50 as to whether the throttle switch is ON or OFF. If the throttle switch is OFF, such correction by learning is made in a step S56 as subtracting the predetermined value $\Delta K$ from the value K as the correction value KG. If the throttle switch is ON, a judgement is made in a step S52 as to whether the flag F is set or not, that is, whether the learning conditions for the correction value TAUG are satisfied or not. Only when the flag F is set, such correction by learning is made in a step S54 as subtracting the predetermined value $\Delta A$ from the value A as the correction value TAUG. Then, the values K, A thus corrected by learning are stored in a predetermined area in the BU-RAM. It is to be noted that no correction by learning is made when the mean value FAFAV is within the range between the predetermined values $1+\alpha$ and $1-\alpha$ and when the flag F is reset.

Consequently, when the learning control conditions are satisifed, correction by learning is made every $C_2$–$C_1$ skips so that the air-fuel ratio feedback correction coefficient approaches 1. In addition, correction by learning is made when $C_1$ skips have been made after the point of time when the open loop control has shifted to the feedback control.

The value A as the correction value TAUG is applied to the above-mentioned equation (1) over all the engine operating regions independently of the ON/OFF state of the throttle switch, and the value K as the correction value KG ($KG_1$, $KG_2$, $KG_3$) is applied to the equation (1) in an engine operating region where learning is effected (FIG. 6). However, the correction value $KG_3$ is applied to the equation (1) even in a region higher than the upper-limit value of the engine operation region, and the correction value $KG_1$ is applied to the equation (1) even in a region lower than the lower-limit value of the engine operating region.

It is to be noted that although in the above embodiment the description has been set forth through the engine adapted to calculate the basic fuel injection quantity in accordance with the intake-pipe pressure and the engine speed, the invention is applicable to an engine adapted to calculate the basic fuel injection quantity in accordance with the intake-air quantity Q/NE per revolution of the engine shaft and the engine speed.

What is claimed is:

1. A method of learn-controlling an air-fuel ratio for an internal combustion engine, comprising the steps of:

(a) obtaining a basic fuel injection time duration in accordance with an engine load and an engine speed;

(b) obtaining an air-fuel ratio feedback correction coefficient for allowing a fuel injection time duration to perform a proportional-plus-integral action in accordance with an output signal from an oxygen sensor for detecting a residual oxygen concentration in an exhaust gas;

(c) varying a correction value for allowing a mean value of said air-fuel ratio feedback correction coefficient to approach a predetermined value corresponding to a target air-fuel ratio, every time said air-fuel ratio feedback correction coefficient skips a plurality of times; and (d) controlling the air-fuel ratio in accordance with said basic fuel injection time duration, said air-fuel ratio feedback correction coefficient and said correction value.

2. A method of learn-controlling an air-fuel ratio for an internal combustion engine according to claim 1, wherein said varying step (c) is carried out when a predetermined period of time has elapsed after a point of time when an air-fuel ratio open loop control has shifted to an air-fuel ratio feedback control.

3. A method of learn-controlling an air-fuel ratio for an internal combustion engine, comprising the steps of:

(a) obtaining a basic fuel injection time duration TP in accordance with an engine load and an engine speed;

(b) obtaining an air-fuel ratio feedback correction coefficient FAF for allowing a fuel injection time duration TAU to perform a proportional-plus-integral action in accordance with an output signal from an oxygen sensor for detecting a residual oxygen concentration in an exhaust gas;

(c) varying, when a throttle valve is at fully closed position, a correction value TAUG for allowing a mean value FAFAV of said correction coefficient FAF to approach a predetermined value corresponding to a target air-fuel ratio, every time said correction coefficient FAF skips a plurality of times, and varying, when the throttle valve is open, a correction value KG for allowing a mean value FAFAV of said correction coefficient FAF to approach the predetermined value corresponding to the target air-fuel ratio, every time said correction coefficient FAF skips a plurality of times; and (d) calculating a fuel injection time duration TAU through the following equation, thereby to control the air-fuel ratio $$TAU=(TP+TAUG)\cdot KG\cdot FAF\cdot(1+F)+\tau_v$$

where, F represents a correction coefficient employed in a transient operation state of the engine and $\tau_v$ represents a non-effective injection time duration.

4. A method of learn-controlling an air-fuel ratio for an internal combustion engine according to claim 3, wherein said varying step (C) is carried out when a predetermined period of time has elapsed after a point of time when an air-fuel ratio open loop control has shifted to an air-fuel ratio feedback control.

5. A method of learn-controlling the air-fuel ratio for an internal combustion engine according to claim 4, wherein said target air-fuel ratio is a stoichiometric air-fuel ratio.

* * * * *